US006230623B1

(12) United States Patent
Dubuit

(10) Patent No.: US 6,230,623 B1
(45) Date of Patent: May 15, 2001

(54) METHOD OF USING A PRINTING MACHINE INCLUDING AT LEAST ONE OBJECT SUPPORT ROTATABLY MOUNTED ON A CONVEYOR, AND CORRESPONDING PRINTING MACHINE

(75) Inventor: Jean-Louis Dubuit, Paris (FR)

(73) Assignee: Societe d'Exploitation des Machines Debuit, a "Societe Anonyme", Noisy le Grand (FR)

( * ) Notice: Subject to any disclaimer, the term of this patent is extended or adjusted under 35 U.S.C. 154(b) by 0 days.

(21) Appl. No.: 09/479,593

(22) Filed: Jan. 7, 2000

(30) Foreign Application Priority Data

Feb. 19, 1999 (FR) ..... 99 02074

(51) Int. Cl.[7] ..... B41F 1/34; B41F 17/08

(52) U.S. Cl. ..... 101/485; 101/487; 101/38.1; 101/40

(58) Field of Search ..... 101/483, 484, 101/485, 487, 38.1, 39, 40, 40.1, 126

(56) References Cited

U.S. PATENT DOCUMENTS

| | | | | |
|---|---|---|---|---|
| 3,960,073 | * | 6/1976 | Rush | 101/40 |
| 4,048,916 | | 9/1977 | Silverman et al. | 101/40 |
| 4,175,993 | * | 11/1979 | Robertson | 101/485 |
| 4,216,044 | * | 8/1980 | Herdzina et al. | 101/40 |
| 4,337,719 | * | 7/1982 | Griendt | 101/40 |
| 4,469,022 | * | 9/1984 | Meador | 101/38.1 |
| 4,592,276 | | 6/1986 | Dubuit . | |
| 5,193,456 | * | 3/1993 | Wolfe et al. | 101/40 |
| 5,379,697 | * | 1/1995 | Ertl | 101/487 |
| 5,383,400 | * | 1/1995 | Szyszko | 101/126 |
| 5,402,718 | * | 4/1995 | Rigodiat | 101/126 |
| 5,564,334 | * | 10/1996 | Burke | 101/40 |
| 5,771,797 | * | 6/1998 | Dubuit | 101/37 |
| 5,894,801 | * | 4/1999 | Ackley | 101/485 |
| 6,164,199 | * | 1/2000 | Dubuit et al. | 101/38.1 |

FOREIGN PATENT DOCUMENTS

| | | |
|---|---|---|
| 0 535 512 | 4/1993 | (EP) . |
| 2 255 178 | 7/1975 | (FR) . |

* cited by examiner

*Primary Examiner*—Eugene Eickholt
(74) *Attorney, Agent, or Firm*—Young & Thompson

(57) ABSTRACT

A printing machine includes at least one object support rotatably mounted on a conveyor which advances stepwise, at least one radiation type drying oven in vertical alignment with the path of movement of the object support and a drive system for driving a rotation cycle of the object support in line with the drying oven when the conveyor is stopped. The drive system modulates the rotation speed of the object support during the rotation cycle as a function of its angular orientation.

9 Claims, 1 Drawing Sheet

METHOD OF USING A PRINTING MACHINE INCLUDING AT LEAST ONE OBJECT SUPPORT ROTATABLY MOUNTED ON A CONVEYOR, AND CORRESPONDING PRINTING MACHINE

BACKGROUND OF THE INVENTION

1. Field of the Invention

The present invention is generally concerned with printing machines including at least one object support rotatably mounted on a conveyor which moves forward stepwise, at least one radiation type drying oven disposed in vertical alignment with the path of movement of the object support and drive means for rotating the object support in line with the drying oven while the conveyor is stopped.

It is more particularly directed to the situation in which, for mechanical reasons, it is possible to rotate the object support only when the conveyor carrying it is completely or substantially completely stopped.

When the object support carrying an object which has previously received printing to be dried reaches the drying oven a non-negligible portion of the perimeter of the object is exposed to the corresponding radiation even before the object begins to rotate and likewise as the object support moves away from the drying oven the same part of the perimeter of the object continues to be exposed to the radiation for some time even though the object is no longer rotating.

2. Description of the Prior Art

At present the object support usually rotates at constant speed. The reason for this is that the corresponding drive means are normally coupled to those which drive the printing means and more generally to those which drive the machine as a whole.

The part of the perimeter of the object which is exposed to the radiation before the object begins to rotate and after it begins to rotate therefore receives a much greater quantity of drying energy than the other part of its perimeter, which is prejudicial to the drying process.

U.S. Pat. No. 4,592,276 attempts to avoid this drawback by means of a mechanical arrangement.

This is difficult to implement in practise, however.

The object of the present invention is an arrangement which avoids this drawback in a very simple and reliable manner.

It is based on the idea of making the drive means operative during drying independent of the drive means operative during printing, the drive means including separate digitally controlled motors, for example.

SUMMARY OF THE INVENTION

To be more precise, the present invention consists firstly in a method of operating a printing machine including at least one object support rotatably mounted on a conveyor which advances stepwise, at least one radiation type drying oven in vertical alignment with the path of movement of the object support and drive means for driving a rotation cycle of the object support in line with the drying oven when the conveyor is stopped and which modulate the rotation speed of the object support during the rotation cycle as a function of its angular orientation; it also consists in any printing machine using a method of the above kind.

In order to implement the invention, the object support drive means include a digitally controlled motor, for example.

Be this as it may, appropriate operation of the drive means in accordance with the invention has the result that the quantity of drying energy received by an object during its rotation cycle is made as uniform as possible around the perimeter of the object, allowing for the quantity of drying energy individually received by the portion of the perimeter exposed to the radiation before and after the rotation cycle.

This has the advantage that drying can be optimized.

The features and advantages of the invention will emerge further from the following description which is given by way of example and with reference to the accompanying diagrammatic drawings.

DETAILED DESCRIPTION OF THE PREFERRED EMBODIMENT

Figure 1:
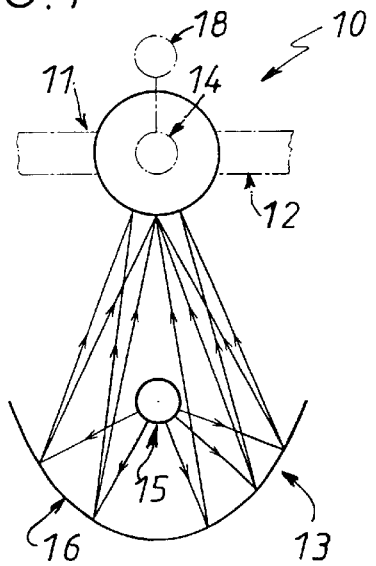
FIG. 1 is an end view of a drying oven equipping the printing machine in accordance with the invention, an object in line with the drying oven and, in schematic form, the relevant parts of the printing machine.

The printing machine 10 in accordance with the invention will not be described in complete detail here.

Only its components needed to understand the invention will be referred to hereinafter.

Suffice to say, in this regard, that the printing machine 10 includes at least one object support 11 rotatably mounted on a conveyor 12 which moves forward stepwise, at least one radiation type drying oven 13 vertically in line with the path of the object support 11 and drive means 14 adapted to rotate the object support 11 in line with the drying oven 13 when the conveyor 12 is stopped.

A plurality of object supports 11 are of course provided from place to place along the conveyor 12.

If the objects to be printed, not shown, are tubes to be filled before they are closed, the object supports 11 are mandrels, for example, over which the tubes are individually nested.

Alternatively, if the objects to be printed are bottles, they can be base-and-spike systems between which such bottles can be individually held by their bottom and their neck.

The drive means 14 associated with each object support 11, which are indicated only diagrammatically in chain-dotted outline in FIG. 1, include any mechanism constrained to rotate with an object support 11, for example.

The conveyor 12, which is also shown only diagrammatically in chain-dotted outline in FIG. 1, can be a turret or a table rotatable about its axis, for example.

The drive means, not shown, assuring the stepwise forward movement of the conveyor 12 usually include an indexing unit which itself rotates.

The drying oven 13 is an ultraviolet radiation type drying oven, for example.

FIG. 1 shows diagrammatically in continuous line the lamp 15 of a drying oven 13 of this kind and the reflector 16 usually associated with the lamp 15.

As shown here, for example, the drying oven 13 is below the conveyor 12.

Alternatively, it can be above it.

Be this as it may, for more details on the various structural features reference may be made to French patent application No. 98 10377 filed Aug. 13, 1998.

That application describes a printing machine for which the present invention is more particularly, although not necessarily exclusively, intended.

In practise, the arrangements are such that when the object support 11 is in line with the drying oven 13 its axis is parallel to the axes of the lamp 15 and the reflector 16.

When an object support 11 is in line with the drying oven 13 in this way, the drive means 14 have to bring about a rotation cycle thereof exposing all of the perimeter of the object it is carrying to the corresponding radiation.

The rotation cycle can comprise one or two turns.

Figure 2:
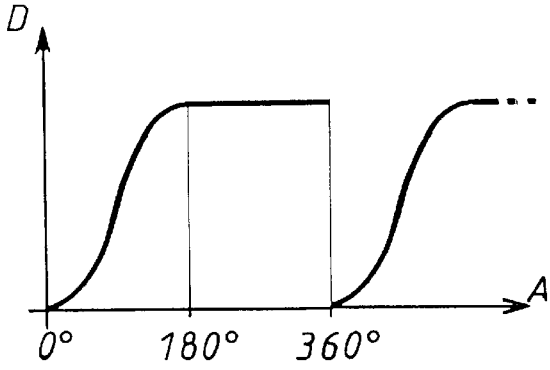
FIG. 2 is a diagram relating to the law of motion of the drive means of the conveyor of the printing machine in accordance with the invention.

According to the law of motion specified by the FIG. 2 diagram, in which the rotation angle A of the indexing unit driving the conveyor 12 is plotted on the horizontal axis and the displacement D of the conveyor 12 is plotted on the vertical axis, the conveyor 12 moves forward by one step while the indexing unit performs a half-turn and is stopped during the next half-turn of the indexing unit.

In theory, an object support 11 can rotate in line with the drying oven 13 only if the conveyor 12 has stopped completely.

In practise, given the tangential nature of the corresponding law of motion at its ends, the rotation of the object support 11 can begin slightly before the conveyor 12 stops and continue slightly after the conveyor restarts.

Confinement means, not shown, are of course associated with the drying oven 13 to minimize diffusion to the exterior of radiation from the lamp 15.

However, despite this, a portion of the perimeter of the object support 11, or to be more precise of the object carried thereby, here the portion of the perimeter facing toward the drying oven 13, receives radiation on approaching the drying oven 13, although the object support 11 is not yet rotating, and likewise when the object support 11 moves away from the drying oven 13 and is therefore no longer rotating.

In accordance with the invention, to alleviate the consequences of such exposure of an object to radiation from the drying oven 13 when it is not moving, the drive means 14 modulate the rotation speed of the object support 11 during its rotation cycle in line with the drying oven 13 as a function of its angular orientation.

To this end, and as shown diagrammatically in chain-dotted outline in FIG. 1, a digitally controlled motor 18 is preferably used in the drive means 14 driving the object support 11.

Figure 3:
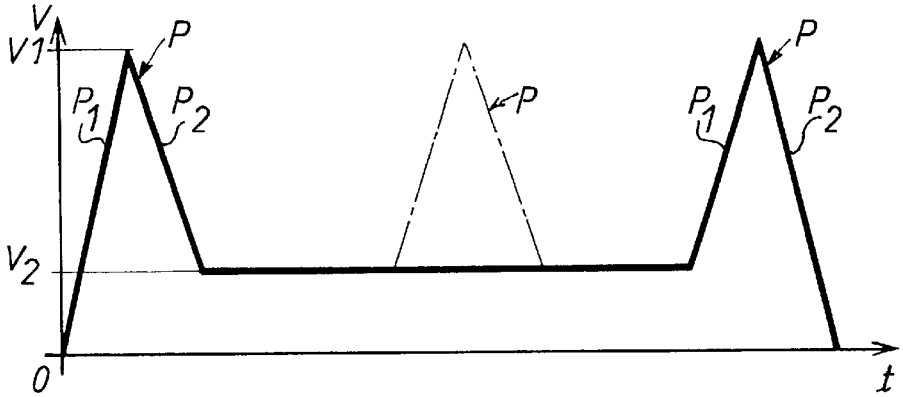
FIG. 3 is a diagram relating to the law of motion for the rotation of an object in line with the drying oven of the printing machine.

In the FIG. 3 diagram, which relates to a rotation cycle of the object support 11, time t is plotted on the horizontal axis and the rotation speed V of the object support 11 during the rotation cycle is plotted on the vertical axis.

In accordance with the invention, the drive means 14 are adapted to cause a speed peak P at the start of the rotation cycle of the object support 11 which corresponds to an acceleration phase P1 followed by a deceleration phase P2 and a speed peak P of the same kind at the end of the rotation cycle.

In practise, all that is required is to control the digitally controlled motor 18 accordingly.

As shown here, for example, the maximum rotation speed V1 reached during a speed peak P is equal to at least twice the nominal rotation speed V2 between two speed peaks P, which is in practise constant.

The nominal rotation speed V2 between two speed peaks P is preferably also slaved to the speed of the printing machine 10 and thus to the speed of the conveyor 12, for smoother overall operation.

Figure 4:
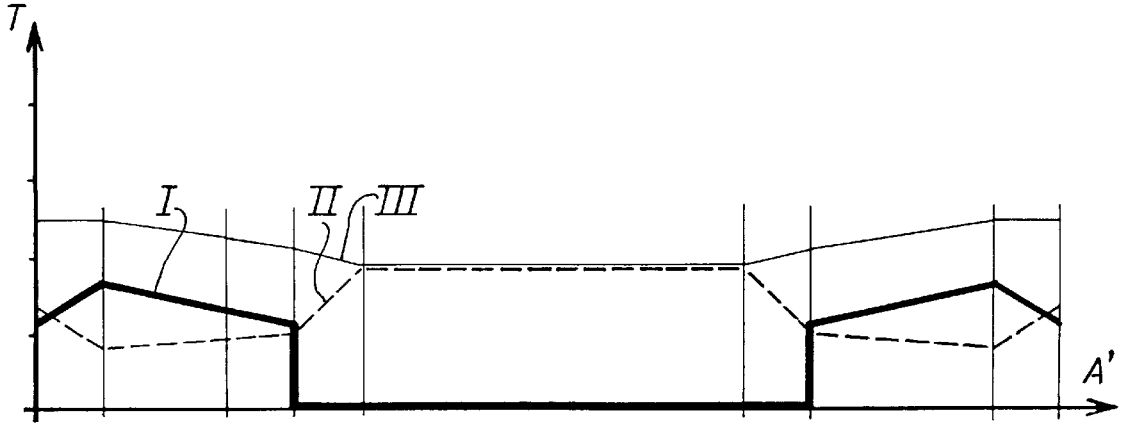
FIG. 4 is a diagram relating to the overall time of exposure of the object to the radiation of the drying oven.

In the FIG. 4 diagram, the angular orientation A' of the object support 11 relative to any reference, and thus the angular orientation of successive areas of the perimeter of the object carried by the object support 11, are plotted on the horizontal axis and the corresponding exposure time T of the object is plotted on the vertical axis.

Curve I corresponds to exposure during forward movement of the conveyor 12.

Curve II corresponds to exposure during rotation of the object support 11.

Curve III gives the total exposure.

Note that the curve III advantageously approximates to a straight line.

In other words, the quantity of drying energy received by the treated object is advantageously made uniform all around the perimeter of the object, which is the required outcome.

If the rotation cycle of the object support 11 in line with the drying oven 13 comprises two turns, as shown in dashed outline in FIG. 3, there is an additional speed peak P centered relative to the speed peak P at the start of the rotation cycle and the speed peak P at the end of the rotation cycle.

In other words, the additional speed peak P is substantially halfway between the other two.

Of course, the present invention is not limited to the embodiment and/or use described and shown, but encompasses any variant thereof.

There is claimed:

1. A method of operating a printing machine including at least one object support rotatably mounted on a conveyor which advances stepwise, at least one radiation type drying oven in vertical alignment with the path of movement of said object support and drive means for driving a rotation cycle of said object support in line with said drying oven when said conveyor is stopped and which modulate the rotation speed of said object support during said rotation cycle as a function of its angular orientation.

2. The method claimed in claim 1 wherein said drive means produce a speed peak at the start of said rotation cycle of said object support corresponding to an acceleration phase followed by a deceleration phase.

3. The method claimed in claim 2 wherein there is also a speed peak at the end of said rotation cycle.

4. The method claimed in claim 3 wherein said rotation cycle of said object support comprises two turns and there is an additional speed peak centered relative to said speed peak at the beginning of said rotation cycle and said speed peak at the end of said rotation cycle.

5. The method claimed in claim 2 wherein the maximum rotation speed reached during a speed peak is at least twice the nominal rotation speed between two speed peaks.

6. The method claimed in claim 5 wherein said nominal rotation speed between two speed peaks is slaved to the speed of said conveyor.

7. The method claimed in claim 1 wherein said drive means of said object support include a digitally controlled motor.

8. A printing machine including at least one object support rotatably mounted on a conveyor which advances stepwise, at least one radiation type drying oven disposed in vertical alignment with the path of movement of said object support and drive means for driving a rotation cycle of said object support in line with said drying oven when said conveyor is stopped, wherein, for the purpose of implementing a method as claimed in claim 1, said drive means of said object support include a digitally controlled motor.

9. The printing machine claimed in claim 8 wherein said nominal rotation speed of said object support is slaved to the speed of said conveyor.

* * * * *